US006637058B1

(12) United States Patent
Lamb

(10) Patent No.: US 6,637,058 B1
(45) Date of Patent: Oct. 28, 2003

(54) SURGICAL PRONE PILLOW STRUCTURE

(76) Inventor: Steve Lamb, 30031 Ahern Ave., Union City, CA (US) 94587-1234

( * ) Notice: Subject to any disclaimer, the term of this patent is extended or adjusted under 35 U.S.C. 154(b) by 0 days.

(21) Appl. No.: 10/131,920

(22) Filed: Apr. 23, 2002

(51) Int. Cl.[7] ..... A47G 9/00
(52) U.S. Cl. ..... 5/638; 5/636; 5/953
(58) Field of Search ..... 5/636, 637, 638, 5/643, 645, 655.9, 740, 953, 727, 644, 654

(56) References Cited

U.S. PATENT DOCUMENTS

| | | | | | |
|---|---|---|---|---|---|
| 3,694,831 | A | | 10/1972 | Treace | |
| 3,846,857 | A | * | 11/1974 | Weinstock | 5/740 X |
| 4,147,825 | A | * | 4/1979 | Talalay | 428/138 |
| 4,357,725 | A | * | 11/1982 | Ahlm | 5/740 |
| 4,731,891 | A | * | 3/1988 | Scheurer et al. | 5/636 |
| 4,752,064 | A | | 6/1988 | Voss | |
| 4,757,983 | A | | 7/1988 | Ray et al. | |
| D298,992 | S | | 12/1988 | Voss | |
| 4,799,275 | A | | 1/1989 | Sprague, Jr. | |
| 4,914,763 | A | * | 4/1990 | Clark | 5/643 |
| 5,048,136 | A | * | 9/1991 | Popitz | 5/636 X |
| 5,140,713 | A | * | 8/1992 | Pesterfield | 5/643 X |
| 5,163,194 | A | | 11/1992 | Dixon | |
| 5,179,742 | A | * | 1/1993 | Oberle | 5/727 |
| D337,914 | S | | 8/1993 | McDonald | |
| 5,269,035 | A | | 12/1993 | Hartunian | |
| 5,481,771 | A | * | 1/1996 | Burk, IV | 5/636 |
| 5,524,308 | A | * | 6/1996 | Hwang et al. | 5/644 |
| 5,613,501 | A | | 3/1997 | Michaelson | |
| 5,669,094 | A | * | 9/1997 | Swanson | 5/953 X |
| 5,848,448 | A | | 12/1998 | Boyd | |
| 6,226,818 | B1 | * | 5/2001 | Rudick | 5/636 |
| 6,523,202 | B2 | * | 2/2003 | Loomos | 5/655.9 X |
| 2002/0124318 | A1 | * | 9/2002 | Loomos | 5/653 |

FOREIGN PATENT DOCUMENTS

| | | | | |
|---|---|---|---|---|
| GB | 2244000 | A | * 11/1991 | 5/740 |

* cited by examiner

*Primary Examiner*—Robert G. Santos
(74) *Attorney, Agent, or Firm*—Theodore J. Bielen, Jr.

(57) ABSTRACT

A surgical prone pillow structure utilizing a base member formed of a compressible resilient material which rapidly assumes an original configuration upon the release of pressure. A upper member formed of a molded resilient closed cell foam material is also employed. The upper member possesses a soft outer surface which is contoured to contact the head of a patient while the patient lies in a prone position. The base member and the soft upper member are connected to one another to form seams which are soft to the touch.

4 Claims, 2 Drawing Sheets

SURGICAL PRONE PILLOW STRUCTURE

BACKGROUND OF THE INVENTION

The present invention relates to a novel and useful surgical prone pillow structure.

Surgical pillows are generally used to support the head and face of a patient during the performance of surgical procedures. In the past, many pillows have been devised to support the head of persons. For example, U.S. Pat. Nos. 4,799,275 and 5,163,195, as well as European Patent EP 0880925 A1 show pillow structures which are intended to provide comfort to the user in various situations.

U.S. Pat. No. 5,848,448 describes a prone position support pillow with cut outs to accommodate anatomical features of the face to provide comfort to the user.

U.S. Pat. Nos. 4,752,064, 5,269,035, 5,613,501, Des. 298,992 and Des. 337,914 show surgical pillows having contoured upper face regions to support the user during surgical procedures.

U.S. Pat. No. 4,757,983 describes a head and chin rest usable for facedown surgical procedures. The base of the pillow has a rocker structure to allow pivoting of the head and chin rest of the patient. The head and chin rests are stabilized with a wedge such as a small towel when a comfortable position is determined.

U.S. Pat. No. 3,694,831 teaches a surgical pillow having a base portion formed of coarse foam which permits air to pass. An upper portion is formed of soft or fine open cell foam which also is pervious to air. The upper foam is finer than the foam employed in the base portion.

A pillow structure which enjoys the resiliency of certain foam materials yet provides a soft contoured non-abrasive surface for contact with the user would be a notable advance in the medical field.

BRIEF SUMMARY OF THE INVENTION

In accordance with the present invention a novel and useful surgical prone pillow structure is herein provided.

The structure of the present invention includes a base member formed of a resilient material. The base member is compressed from an original configuration under pressure and is capable of assuming the original configuration upon the removal of such pressure. For example, the base member may be formed of an open cell foam material of moderate density. The base member may be formed by die-cutting. Such die-cutting would contour the inner portion of the base member to conform to the extremities of the face which may enter that region.

An upper member is also included in the present invention. The upper member is formed of a molded resilient, closed cell foam material. The upper member possesses a very soft outer surface which is contoured to contact the head of the patient in a position for the performance of surgery. The contoured upper member closely follows the contours of the base member therebelow.

Means is also provided for connecting the base member to the upper member. Such connecting means may take the form of an adhesive which holds the base member to the upper member. A seam is formed between the base member and the upper member which is soft to the touch. Such non-abrasive seam is achieved by recessing the adhesive material away from the outer surfaces of the upper member and base member. Thus, cured adhesive, which tends to be quite hard, is not accessible to the skin of the patient using the structure of the present invention.

In many cases, the upper member may be formed of closed cell foam material of a certain density. Such density may be varied according to the surgery being performed and the characteristics of the patient, such as weight and size, the density of the base member is not varied. In addition, the mass of the base member generally exceeds the mass of the upper member to provide stability to the pillow structure of the present invention. The base member, possessing excellent resiliency, generally forms a shock absorbing element, while the upper member, although resilient, provides softness and comfort.

It may be apparent that a novel and useful surgical prone pillow structure has hereinabove been described.

It is therefore an object of the present invention to provide a surgical pillow structure which includes a very resilient base member and a less resilient, but soft, upper member utilized in tandem.

Another object of the present invention is to provide surgical pillow structure which employs an upper member portion which is molded to provide a soft and easily contoured element that effectively fits facial features of a patient.

A further object of the present invention is to provide a surgical pillow structure which includes polymeric foam members of different characteristics which are seamed together without creating abrasive edges.

Another object of the present invention is to provide a surgical pillow structure which comfortably supports a patient during surgery and eliminates abrasion injury during surgical procedures.

A further object of the present is to provide a surgical pillow structure which incorporates the employment of an intubation tube.

The invention possesses other objects and advantages especially as concerns particular characteristics and features thereof which will become apparent as the specification continues.

Figure 1:
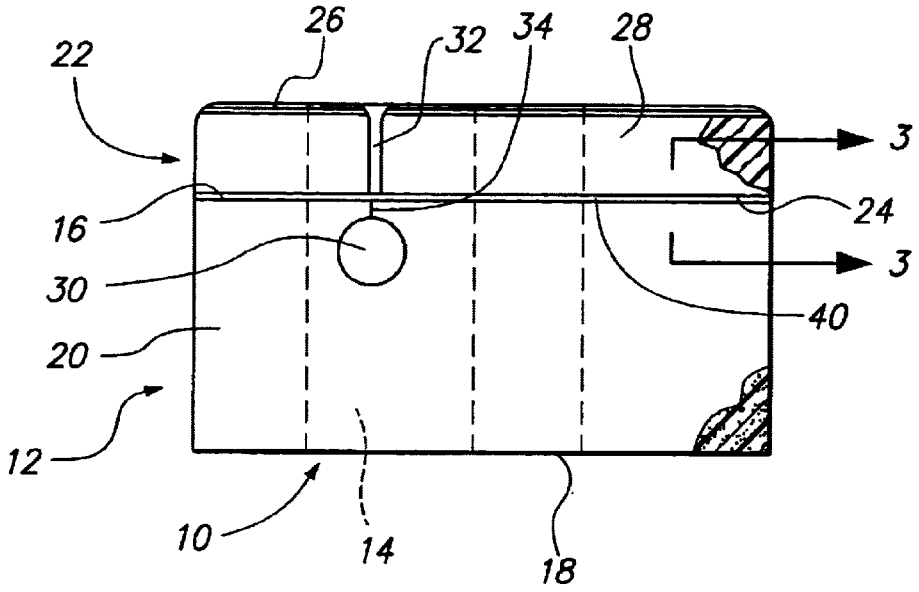
FIG. 1 is a side elevational view of the structure of the present invention showing portions in cutaway configuration for the purpose of revealing material characteristics.

For a better understanding of the invention reference is made the following detailed description of the preferred embodiments thereof which should be referenced to the hereinabove described drawings.

DETAILED DESCRIPTION OF THE PREFERRED EMBODIMENTS OF THE INVENTION

Various aspects of the present invention will evolve from the following detailed description of the preferred embodiments thereof which should be taken together with the above delineated drawings.

The preferred embodiment of the invention is shown in whole in the drawings by reference character 10. Surgical prone pillow structure 10 includes as one of its elements a base member 12 formed as a block of resilient material. For example, base member 12 may be formed of an open cell, die-cut, polymeric material such as polyurethane, polyethylene, and the like. Most importantly, base member 12 is formed of a resilient material which is capable of being compressed from an original configuration under pressure to a compressed state. Release of such pressure will allow the base member 12 to assume its original configuration within a short time period, a matter of seconds. Base member 12, being an open cell foam, permits the passage of air therethrough and into cavity 14 which extends through base member 12 from upper surface 16 to lower surface 18. Base member 12 is essentially a rectangular solid formed by top surface 16, bottom surface 18, and upwardly extending side portion 20.

Figure 2:
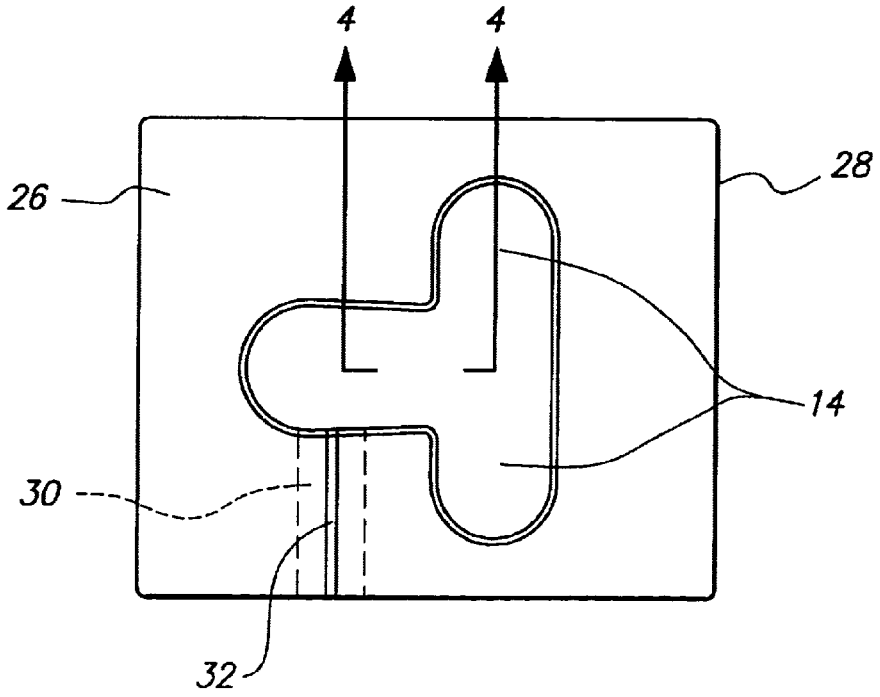
FIG. 2 is a top plan view of the pillow structure of the present invention.

Structure 10 also includes as one of its elements an upper member 22. Upper member 22 includes a bottom surface 24, an upper surface 26, and side surface 28. Again, upper member 22 takes the form of a rectangular solid and includes an extension of cavity 14 through the center portion, best shown in FIG. 2. Upper member 22 is formed of a molded, resilient closed cell foam material such that upper surface 26, and the edge portions surrounding cavity 14 are radius. All the surfaces 24, 26, and 28 of upper member 22 are soft. Upper member 22 is resilient, but not as resilient as base member 12. Upper member 22 may be formed into various densities depending of the type of surgical procedure being used and the characteristics of the patient being operated upon. For example, a heavier of bulkier patient would require upper member 22 to possess a higher density. The mass of upper member 22 is somewhat less than the mass of base member 12 to provide stability to the structure 10 as shown.

An aperture 30 through base member 12 allows the insertion of an intubation tube 52 during surgical procedures. Slot 32 of upper member 22 and slit 34 of base member 12 permit the intubation tube to be pushed downwardly into aperture 30 for use.

Figure 3:
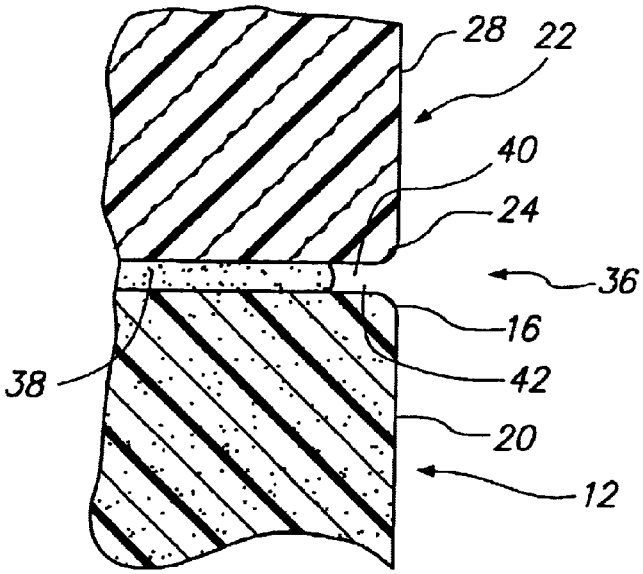
FIG. 3 is a sectional view taken along line 3—3 of FIG. 1.
Figure 4:
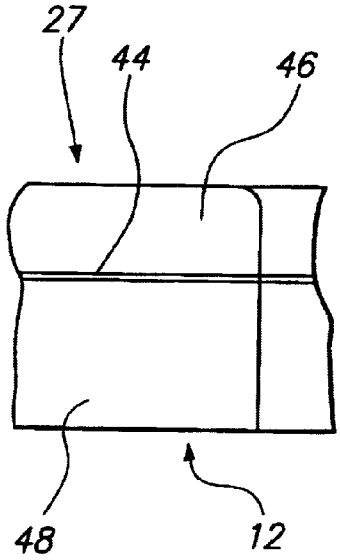
FIG. 4 is a elevational view taken along line 4—4 of FIG. 2.
Figure 5:
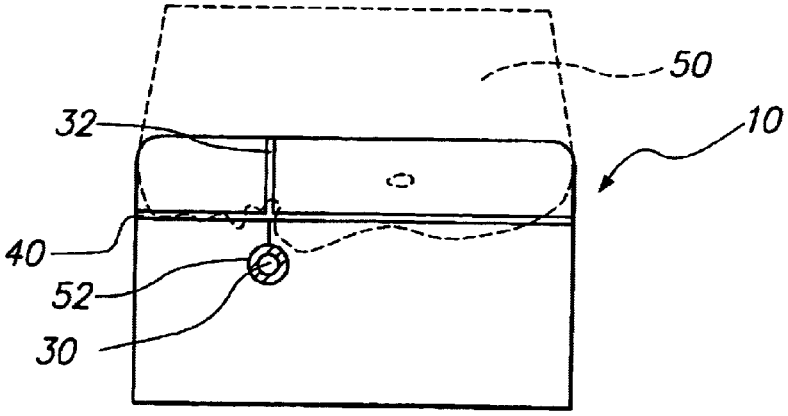
FIG. 5 is a side elevational view of the structure of the present invention in use with a patient, shown in phantom.

Pillow structure 10 also includes means 36 for connecting base member 12 to upper member 22, FIG. 3. Means 36 may take the form of an adhesive layer 38 which is constructed of any suitable material capable of bonding upper member 22 to base member 12. Most importantly, seam 40 is formed between base member 12 and upper member 22. Adhesive layer 38 is recessed from outer surface of base member 12 and outer surface 28 of upper member 22, leaving a gap 42. Any contact with the surfaces of base member 12 and/or upper member 22 will not entail contacting hardened adhesive layer 38. It should be noted that seam 40 extends about the outer surface of structure 10. In addition, a seam 44 is formed between inner surface 46 of upper member 22 and inner surface 48 of base member 12, FIG. 4. Seam 44 is located within cavity 14 of structure 10.

In operation, upper member 22 is selected from a particular density and adhered to base member 12 by the use of connecting means 36, namely adhesive layer 38. Positioning of adhesive layer 38 between upper member 22 and base member 12 obviates hard edges between base member 12 and upper member 22. Intubation tube 52 is then passed through aperture 30 using slot 32 and slit 34. The patient's head 50 is then placed facedown into cavity 14 of structure 10. The skin portions of head 50 contact soft upper member surface 26 and side surface 46 within cavity 14. Seam 44 between base member 12 and upper member 22 is also soft to the touch since adhesive layer 38 is recessed from such surfaces at seam 44. The patient 50 is supported comfortably and is unlikely to receive abrasive injuries due to structure 10 while a surgical procedure takes place.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A surgical prone pillow structure, comprising:

a. a base member, said base member formed of a resilient material being compressible from an original configuration under pressure and being capable of assuming said original configuration upon the removal of said pressure;

b. an upper member formed of a molded resilient closed cell foam material said upper member possessing a soft outer surface contained to contact the head of the patient in a position for the performance of surgery thereupon, said upper member overlying said base member;

c. a cavity extending through said base member and said upper member overlying said base member; and d. means for connecting said base member to said upper member, said means including a surface of said base member nested against a surface of said upper member, said surfaces of said base member and said upper member terminating in a seam in said cavity, said surface of said upper member, said layer of adhesive being recessed from said seam at said cavity.

2. The structure of claim 1 in which said base member is constructed of an open cell foam polymeric material.

3. The structure of claim 1 in which the density of said upper member differs from the density of said base member.

4. The structure of claim 1 in which the mass of said base member exceeds the mass of said upper member.

* * * * *